US009982219B2

(12) United States Patent
Waters

(10) Patent No.: US 9,982,219 B2
(45) Date of Patent: May 29, 2018

(54) SUSTAINABLY SOURCED, NON-HYDROGENATED, PLANT BASED CANDLE COMPOSITIONS

(71) Applicant: Jessica Waters, Encinitas, CA (US)

(72) Inventor: Jessica Waters, Encinitas, CA (US)

( * ) Notice: Subject to any disclaimer, the term of this patent is extended or adjusted under 35 U.S.C. 154(b) by 617 days.

(21) Appl. No.: 14/634,619

(22) Filed: Feb. 27, 2015

(65) Prior Publication Data

US 2016/0251597 A1 Sep. 1, 2016

(51) Int. Cl.
*C11C 5/00* (2006.01)
*F23D 3/16* (2006.01)

(52) U.S. Cl.
CPC ..... *C11C 5/008* (2013.01); *C11C 5/00* (2013.01); *C11C 5/002* (2013.01); *F23D 3/16* (2013.01)

(58) Field of Classification Search
CPC . C11C 5/008; C11C 5/00; C11C 5/002; F23D 3/16
See application file for complete search history.

(56) References Cited

U.S. PATENT DOCUMENTS 7,588,607 B1 * 9/2009 Cap ..... C11C 5/002 431/288
8,939,758 B2 1/2015 Kodali et al.
2006/0236593 A1 10/2006 Cap
2010/0212214 A1 8/2010 Wu et al.

OTHER PUBLICATIONS

Ewing, Kelly, Making Candles and Soaps for Dummies, 2010, Wiley & Sons, p. 110.*
Anonymous, "Warousoku—Japanese Traditional Candles," retrieved Apr. 14, 2015, from < http://uguisustore.com/collections/traditional-candles?page=1>.
Anonymous, "Warousoku—Japanese Traditional Candles," retrieved Apr. 14, 2015, from < http://uguisustore.com/collections/traditional-candles?page=2>.
Marshall (2013). "London's Industrial Heritage," The History Press, Stroud, Gloucestershire, UK, pp. 66 to 68.
Wikipedia, "History of candle making," retrieved Apr. 14, 2015 from <http://en.wikipedia.org/wiki/History_of_candle_making>.

* cited by examiner

*Primary Examiner* — Cephia D Toomer
(74) *Attorney, Agent, or Firm* — Morrison & Foerster LLP

(57) ABSTRACT

The present disclosure relates to candle compositions. In particular, the disclosure relates to rice bran wax/coconut oil candle compositions and methods for making such compositions.

23 Claims, No Drawings

SUSTAINABLY SOURCED, NON-HYDROGENATED, PLANT BASED CANDLE COMPOSITIONS

FIELD OF THE INVENTION

The present disclosure relates to candle compositions. In particular, the disclosure relates to candle compositions made with rice bran wax and coconut oil.

BACKGROUND

Candles can be made with various natural and synthetic raw materials. Traditional base raw materials that are used in candle manufacturing include paraffin wax, beeswax, and hydrogenated vegetable oils. Currently, paraffin wax is most commonly used due to its low cost and the availability of different grades of waxes with different melting profiles and physical properties.

The traditional raw materials for candles have many disadvantages. Paraffin wax is a byproduct of refined petroleum oil. Petroleum oil is not a renewable source and the wax that is removed from refined oil is further processed with bleaching agents and additives. While beeswax may be considered to be sustainable, there are currently no beeswax products certified GMO-free by the Non-GMO Project. Beeswax may also not be desired by consumers who seek out animal-free products. Waxes made from vegetable oils, such as soy oil and palm oil, are an alternative. However, the oils must be hydrogenated in order to raise the melting temperature to be acceptable for candle making. Furthermore, soy oil is sourced from GMO plants and palm oil plantations continue to be criticized for violating human rights, child labor and clear cutting forests that threaten wildlife.

Thus, there is a need for sustainably sourced, non-hydrogenated, GMO-free, animal-free, plant based candle compositions having long burn times.

BRIEF SUMMARY

The present disclosure provides sustainably sourced candle compositions with long burn times. A blend of rice bran wax and coconut oil produces a candle composition that is made entirely of sustainably sourced, non-hydrogenated, animal-free, plant based non-GMO materials. These candle compositions are food safe and have the potential to be certified GMO-FREE in addition to organic and fair trade.

In one aspect the present disclosure relates to a candle composition including, but not limited to rice bran wax and coconut oil in a weight ratio of about 3:2 to about 4:1. In one embodiment, the candle composition includes, but is not limited to rice bran wax and coconut oil in a weight ratio of about 4:1. In another embodiment, the candle composition includes, but is not limited to rice bran wax and coconut oil in a weight ratio of about 7:3.

In another aspect, the present disclosure relates to a candle composition including, but not limited to about 60% to about 80% by weight rice bran wax and about 20% to about 40% coconut oil. In one embodiment, the candle composition includes about 70% by weight rice bran wax and about 30% by weight coconut oil. In another embodiment, the candle composition includes about 63% to about 70% by weight rice bran wax, about 27% to about 30% by weight coconut oil, and about 0% to about 10% by weight scent. In still yet another embodiment, the candle composition includes about 80% by weight rice bran wax and about 20% by weight coconut oil. In still yet another embodiment, the candle composition includes about 72% to about 80% by weight rice bran wax, about 18% to about 20% by weight coconut oil, and about 0% to about 10% by weight scent.

In another aspect, the present disclosure relates to a candle composition including, but not limited to about 60% to about 80% by weight rice bran wax and about 0% to about 10% by weight scent, wherein the remainder by weight is coconut oil.

In still yet another aspect, the candle composition includes base fuel including, but not limited to about 60% to about 80% by weight rice bran wax, wherein the remainder by weight of the base fuel is coconut oil; and about 0% to about 10%, based on the total weight of the candle composition, of scent.

In embodiments that can be combined with any of the other described embodiments, the candle composition also includes scent. The scent may be an essential oil, such as that from oranges, eucalyptus, peppermint, lavender, or cedarwood. The scent may be present in a ratio of about 1:100 to about 1:18 to the total weight of rice bran wax and coconut oil, preferably in a ratio of about 1:16 to the total weight of rice bran wax and coconut oil.

In embodiments that can be combined with any of the other described embodiments, the coconut oil in the candle composition is virgin coconut oil.

In embodiments that can be combined with any of the other described embodiments, the candle composition has at least one wick. They wick may be any high melting point wick. The wick may be a square braid wick.

In embodiments that can be combined with any of the other described embodiments, the candle composition is in the shape of a pillar, within a container, or in the shape of a taper candle, and/or includes an outer layer of colored wax.

In another aspect, the present disclosure relates to a method for making a candle composition, including, but not limited to the following steps: mixing rice bran wax and coconut oil in a weight ratio of about 3:2 to 4:1, heating the mixture to about 185 to 190° F., suspending a wick in a container or mold, pouring the mixture into a container or mold, and cooling the mixture.

In still another aspect, the present disclosure relates to a method for making a candle composition, including, but not limited to the following steps: mixing rice bran wax and coconut oil in a weight ratio of about 3:2 to 4:1, heating the mixture to about 180 to 185° F., dipping a wick in the mixture, and cooling the mixture.

DETAILED DESCRIPTION OF THE PREFERRED EMBODIMENTS

Candle Compositions

The candle compositions described herein include, but are not limited to, the ingredients of rice bran wax and coconut oil. The proportions of rice bran wax and coconut oil can be varied depending on the desired melting temperature, burn pool size, candle size, and production costs.

Rice bran wax alone has a very high melting temperature of 77-82° C. (170° F.-180° F.) and is best used for manufacturing free-standing candles such as tapers, pillars, tealights and votives. Coconut oil is a semi-solid oil that has a melting temperature of 24° C. (76° F.). Coconut oil can be used at different weight ratios with respect to the rice bran wax and/or used at different weight percentages to lower the overall melting temperature into the typical range of 120° F.-165° F. to allow for wider burn pools and more candle size options. Use of increased amounts of coconut oil also reduces production costs, as rice bran wax has a higher per pound cost than traditional candle waxes. Furthermore, the mixture of rice bran wax and coconut oil cools quickly and may reduce production times.

In certain embodiments, the candle compositions include rice bran wax and coconut oil in a weight ratio ranging from 3:2 to 4:1. In other embodiments, the rice bran wax/coconut oil weight ratio of the candle composition ranges from 3:2 to 3:1, 3:2 to 7:3, 3:2 to 2:1, 2:1 to 4:1, 2:1 to 3:1, 2:1 to 7:3, 7:3 to 4:1, or 7:3 to 3:1. In still other embodiments, the rice bran wax/coconut oil ratio of the candle composition may be 3:2, 2:1, 7:3, 3:1, or 4:1. The candle compositions may also include other ingredients, such as a scent.

In certain embodiments, the candle compositions include 60% to 80% by weight rice bran wax and 20% to 40% coconut oil. Examples of such candle compositions include compositions totaling 100 grams that contain 60 to 80 grams of rice bran wax and 20 to 40 grams of coconut oil. Another example of such a composition is one totaling 100 grams that contains 70 grams rice bran wax, 25 grams coconut oil, and 5 grams of scent. Other candle compositions may have a rice bran wax weight percentage ranging from 60%-75%, 60%-70%, 60%-65%, 65%-80%, 65%-75%, 65%-70%, 70%-80%, or 70%-75%; and/or a coconut oil weight percentage ranging from 20%-35%, 20%-30%, 20%-25%, 25%-40%, 25%-35%, 25%-30%, 30%-40%, or 30%-35%. In other embodiments, candle compositions have rice bran wax weight percentage of 60%, 65%, 70%, 75%, or 80%; and/or a coconut oil weight percentage of 40%, 35%, 30%, 25%, or 20%.

In certain embodiments, the candle compositions include 60% to 80% by weight rice bran wax, wherein the remainder by weight is coconut oil. For example, a candle containing 60 grams of rice bran wax would contain 40 grams of coconut oil.

In other embodiments, the candle compositions are used to make harder candles with a small burn pool. Such candle compositions may include more rice bran wax and less coconut oil than the ratios and percentages described above. For example, candle compositions may have a rice bran wax/coconut oil ratio ranging from 4:1 to 9:1, such as 17:3 or 9:1. Expressed differently, the candle composition may have a rice bran wax weight percentage ranging from 80% to 90%, such as 85% or 90%, and/or a coconut oil weight percentage ranging from 20% to 10%, such as 15% or 10%.

In addition to the ratios and percentages listed above, ratios or percentages about or approximately the same as any of the listed ratios and percentages are also found in certain embodiments.

The candle compositions described herein may be in a variety of shapes, including, but not limited to, the shape of taper candle or a molded candle, such as a pillar. Alternatively, the candle may be situated within a container.

In certain embodiments, the candle composition is in the shape of a taper candle. Diner/taper candles are typically about 1 inch thick and only require a small burn pool of 1 inch or less. In preferred embodiments, a taper candle composition includes 80% by weight rice bran wax and 20% by weight coconut oil, or 70% by weight rice bran wax and 30% by weight coconut oil.

In other embodiments, the candle composition is a pillar. Pillar candles need a larger burn pool than taper candles in order for the candle to properly melt. In preferred embodiments, the pillar includes 70% by weight rice bran wax and 30% by weight coconut oil, or 60% rice bran wax and 40% coconut oil.

In some embodiments, the candle composition includes an outer layer of colored wax. The colored wax typically includes natural earth pigments such as clays and umbers.

The candle compositions described herein have long burn times. Such burn times may be as long as or longer than that of comparably sized and shaped beeswax candles. For example, the candle compositions herein may have burn times that are 5%, 10%, 15%, 20%, 25%, 30%, 35%, 40%, 45%, or 50% longer than that of comparably sized and shaped beeswax candles, or at least half an hour, 1 hour, 2 hours, 3 hours, 4 hours, 5 hours, 10 hours, 15 hours, 20 hours, 25 hours, or 50 hours longer than that of comparably sized and shaped beeswax candles.

Rice Bran Wax

Rice bran wax (*Oryza sativa* bran wax) is a byproduct of winterized rice bran oil, which is rice bran oil that has been cooled to separate the oil from the wax. The filtering and refining of crude rice bran wax is an organic process, with no additional ingredients added to the wax. The global supply of crude rice bran oil and wax is currently only sourced from GMO-free food crops. The high melting point of rice bran wax is advantageous as it allows for use in a wider range of climates than low melting point vegetable waxes.

In some embodiments, the rice bran wax used in the candle compositions described herein has at least one of the following characteristics: Melting Point: 77-82° C., Acid Value: ≤13, Saponification Value: 75-120, and Iodine Value: ≤20.0. In certain embodiments the rice bran wax is sourced from Koster Keunen.

Coconut Oil

Coconut oil (*Cocos nucifera* oil) is useful in the candle compositions described herein for lowering the melting point of rice bran wax, which can be brittle on its own and only generates small burn pools. Coconuts are considered a sustainable source of oil as the coconut tree can live and bear fruit for up to 60 years. The fruit is more valuable than its wood so the tree is left to stand for its entire fruit bearing lifecycle. In addition, coconut oil is unprocessed, not hydrogenated, and can be certified GMO-free.

The coconut oil used in the candle compositions described herein is preferably virgin coconut oil. The virgin coconut oil may be cold-pressed or centrifuged. Cold-pressed virgin coconut oil can be made by drying fresh coconut meat and pressing oil from the dried meat. Centrifuged virgin coconut oil can be made by chopping coconuts, pressing them with an expeller to produce coconut milk and then centrifuging to separate the oil from the milk.

In some embodiments, the coconut oil used in the candle compositions described herein has at least one of the following characteristics: melting point: 70-79° F.; iodine value: 6-11 g/100 g; saponification value 245-265; free fatty acid percentage: less than 1. In certain embodiments the coconut oil is Green Label Cold Pressed Virgin Coconut Oil sourced from Tropical Traditions.

Wick

The candle composition typically contains at least one wick. The wick used can be hemp-core cotton, coreless cotton, cotton with paper filaments, flat-braided wick, or a wick having a paper core. The wick is preferably a high-melting point wick, such as a square braid wick, an ECO wick, a hemp-core wick or a coreless cotton wick. In certain embodiments, the wick is a square braid wick.

Scent

In certain embodiments, the candle compositions include scent. Scents include both artificial fragrances and scents derived from natural sources. The scent is preferably an essential oil, such the oils derived from oranges, eucalyptus, peppermint, lavender, and cedarwood.

Typically, the scent is present in a weight ratio of 1:18 to 1:10 to the total weight of rice bran wax and coconut oil. In certain embodiments, the scent is present in a weight ratio of 1:75, 1:50, 1:25 or 1:16. In addition to the ratios listed above, ratios about or approximately the same as any of the listed ratios are also found in certain embodiments.

In the embodiments including scent, the weight percentages of rice bran wax and coconut oil described in the above sections may be adjusted to account for the addition of scent. For example, such candle compositions may include 63% to 70% by weight rice bran wax, 27% to 30% by weight coconut oil, and 0% to 10% by weight scent. Alternatively, the candle compositions may include 72% to 80% by weight rice bran wax, 18% to 20% by weight coconut oil, and 0% to 10% by weight scent. The candle compositions may also include 60% to 80% by weight rice bran wax and 0% to 10% by weight scent, wherein the remainder by weight is coconut oil. In another variation, the candle compositions include base fuel having 60% to 80% by weight rice bran wax, wherein the remainder by weight of the base fuel is coconut oil; and 0% to 10%, based on the total weight of the candle composition, of scent. The percentage of the scent in any of the above embodiments may be 0.5%, 1%, 2%, 3%, 4%, 5%, 6%, 7%, 8%, 9%, or 10%. In addition to the percentages listed above, percentages about or approximately the same as any of the listed percentages are also found in certain embodiments.

Methods for Making a Candle Composition

Methods for making the candle compositions described above are also provided.

In certain embodiments, the methods include, but are not limited to, the steps of mixing rice bran wax and coconut oil in weight ratios or at weight percentages as described above, heating the mixture to about 185 to 190° F., suspending a wick in a container or mold, pouring the mixture into a container or mold, and cooling the mixture. Alternatively, the methods include the steps of mixing rice bran wax and coconut oil in weight ratios or at weight percentages as described above, heating the mixture to about 185 to 190° F., and dipping a wick into the mixture.

In other embodiments, the methods include, but are not limited to, the steps of mixing rice bran wax and coconut oil in a weight ratio of about 3:2 to 4:1, heating the mixture to about 180 to 185° F., suspending a wick in a container or mold, pouring the mixture into a container or mold, and cooling the mixture. Alternatively, the methods include the steps of mixing rice bran wax and coconut oil in weight ratios of about 3:2 to 4:1, heating the mixture to about 180 to 185° F., and dipping a wick into the mixture.

EXAMPLES

The following Examples are offered for illustrative purposes and to aid one of skill in better understanding the various embodiments of the disclosure. They are not intended to limit the scope of the present disclosure in any way.

Example 1: Molded Candle Manufacture

Ingredients

Rice Bran Wax from Koster Keunen

Organic Virgin Coconut Oil

Manufacturing Method

Combine coconut oil and rice bran wax in a melter.

Heat ingredients to 185-190° F. and agitate to blend ingredients thoroughly.

If using fragrances or essential oils, blend into melted wax just before pouring.

Once melted, pour wax into a mold, leaving some melted wax in your pour pot for the second pour. If using a pillar mold, fill to the brim.

Once the top of the candle forms a half inch layer of cooled wax, poke relief holes to release any air bubbles. This may need to be done several times depending on the size of the candle.

Once the candle is mostly cooled, pour a second layer with the leftover melted wax to cover the relief holes. This wax should be heated slightly higher than original melting temperature so as to avoid a visual "fill line" with the second pour. It may also be necessary to agitate melted wax before pouring to ensure ingredients are well blended.

Once your mold is cool to the touch, the candle is ready to be removed from the mold.

Cure the candle for approximately 4 hours. A cured candle will develop a slightly lighter color in appearance than a freshly formed candle.

Example 2: Hand-dipped Taper Candle Manufacture

Ingredients

Rice Bran Wax from Koster Keunen

Organic Virgin Coconut Oil

Manufacturing Method

Combine coconut oil and rice bran wax in a melter or dipping vat.

Heat ingredients to 180-185° F. and agitate to blend ingredients thoroughly.

Use a dipping ring to prepare wick for dipping.

Once the wax is melted, dip wick into the melted wax and then immediately remove the wick allowing excess wax to drip off. The fresh layer of wax on the wick will cool and harden. If the wick is pulled out quickly, a taper style candle will eventually form with the top of the candle smaller in dimension than the bottom. If the wick is dipped at a more consistent pace, the candle will form a more straight up and down edge.

Allowing the candle to cool in between dips, repeat the dipping process until desired width of candle is achieved.

The newly finished candle will be warm to the touch. Cut the bottom of the candle away from the dipping ring and remove candle.

Apply a finishing coat of hot wax to give the candle a smooth finish by heating the wax to a higher temperature of 195° F. and dipping the candle 1-2 times into the hot wax. Remove the candle quickly from the hot wax and allow to cool.

Allow the candles to hang and fully cool and harden for approximately 4 hours. A cured candle will develop a slightly lighter color in appearance than a freshly formed candle.

Example 3: Rice Bran Wax/Coconut Oil Candle Performance vs. Beeswax Candle Performance Candles were manufactured as described in the above Examples. The burn times of candles composed of 70% rice bran wax and 30% coconut oil are provided below:

2"×4.5" PILLAR CANDLE: 45 HOURS

2"×9.5" PILLAR CANDLE: 100+ HOURS

2 OZ. VOTIVE: 16 HOURS

1 OZ. TEALIGHT: 8 HOURS

These burn times were either as long as or longer than the burn times for beeswax candles, another high melting point candle. Burn times for beeswax candles are listed below.

2"×4.5" PILLAR CANDLE: 36 HOURS (as listed on manufacturer website)

2"×9.5" PILLAR CANDLE: 85 HOURS (as listed on manufacturer website)

2 OZ. VOTIVE: 12 HOURS (tested by Applicant)

1 OZ. TEALIGHT: 8 HOURS (tested by Applicant)

What is claimed is:

1. A candle wax composition comprising rice bran wax and unprocessed, non-hydrogenated coconut oil in a weight ratio of about 3:2 to about 4:1.

2. The candle wax composition of claim 1, wherein the composition comprises rice bran wax and unprocessed, non-hydrogenated coconut oil in a weight ratio of about 4:1.

3. The candle wax composition of claim 1, wherein the composition comprises rice bran wax and unprocessed, non-hydrogenated coconut oil in a weight ratio of about 7:3.

4. A candle wax composition comprising about 60% to about 80% by weight rice bran wax and about 20% to about 40% unprocessed, non-hydrogenated coconut oil.

5. The candle wax composition of claim 4, wherein the composition comprises about 70% by weight rice bran wax and about 30% by weight unprocessed, non-hydrogenated coconut oil.

6. The candle wax composition of claim 4, wherein the composition comprises about 63% to about 70% by weight rice bran wax, about 27% to about 30% by weight unprocessed, non-hydrogenated coconut oil, and about 0% to about 10% by weight scent.

7. The candle wax composition of claim 4, wherein the composition comprises about 80% by weight rice bran wax and about 20% by weight unprocessed, non-hydrogenated coconut oil.

8. The candle wax composition of claim 4, wherein the composition comprises about 72% to about 80% by weight rice bran wax, about 18% to about 20% by weight unprocessed, non-hydrogenated coconut oil, and about 0% to about 10% by weight scent.

9. A candle wax composition comprising about 60% to about 80% by weight rice bran wax and about 0% to about 10% by weight scent, wherein the remainder by weight is unprocessed, non-hydrogenated coconut oil.

10. A candle wax composition comprising base fuel comprising about 60% to about 80% by weight rice bran wax, wherein the remainder by weight of the base fuel is unprocessed, non-hydrogenated coconut oil; and about 0% to about 10%, based on the total weight of the candle wax composition, of scent.

11. The candle wax composition of claim 1, wherein the composition further comprises scent.

12. The candle wax composition of claim 11, wherein the scent is an essential oil.

13. The candle wax composition of claim 11, wherein the scent is present in a ratio of about 1:100 to about 1:18 to the total weight of rice bran wax and unprocessed, non-hydrogenated coconut oil.

14. The candle wax composition of claim 11, wherein the scent is present in a ratio of about 1:16 to the total weight of rice bran wax and unprocessed, non-hydrogenated coconut oil.

15. The candle wax composition of claim 12, wherein the essential oil is from a plant selected from the group consisting of: oranges, eucalyptus, peppermint, lavender, and cedarwood.

16. The candle wax composition of claim 1, wherein the unprocessed, non-hydrogenated coconut oil is virgin coconut oil.

17. The candle wax composition of claim 1, wherein the composition comprises at least one wick.

18. The candle wax composition of claim 17, wherein the wick is a high melting point wick.

19. The candle wax composition of claim 17, wherein the wick is a square braid wick.

20. The candle wax composition of claim 1, wherein the composition is in the shape of a pillar.

21. The candle wax composition of claim 1, wherein the composition is within a container.

22. The candle wax composition of claim 1, wherein the composition is in the shape of a taper candle.

23. The candle wax composition of claim 1, wherein the composition further comprises an outer layer of colored wax.

* * * * *